US005294054A

United States Patent [19]

Benedict et al.

[11] Patent Number: 5,294,054

[45] Date of Patent: Mar. 15, 1994

[54] ADJUSTABLE SHOWERHEAD ASSEMBLIES

[75] Inventors: Charles E. Benedict; Thomas B. Middlebrooks; Robert G. Stampfli; Victor C. Cordiano, all of Tallahassee; Charles W. Belt, Homossasa; Jay S. Tiedeberg, Tallahassee, all of Fla.

[73] Assignee: Benedict Engineering Company, Inc., Tallahassee, Fla.

[21] Appl. No.: 9,749

[22] Filed: Jan. 27, 1993

Related U.S. Application Data

[63] Continuation-in-part of Ser. No. 886,857, May 22, 1992, abandoned.

[51] Int. Cl.[5] ..... B05B 3/04

[52] U.S. Cl. ..... 239/222.15; 239/240; 239/383; 239/446

[58] Field of Search ..... 239/380, 381, 383, 222.15, 239/237, 240, 443, 446, 135

[56] References Cited

U.S. PATENT DOCUMENTS

| | | | |
|---|---|---|---|
| 197,733 | 12/1877 | Kirby et al. | 239/383 |
| 473,759 | 4/1892 | Klein | 239/383 |
| 2,622,927 | 12/1952 | Sarbu | 299/69 |
| 3,312,400 | 4/1967 | Clearman | 239/206 |
| 3,485,451 | 12/1969 | Gore et al. | 239/383 |
| 3,568,716 | 3/1971 | Hetzman | 239/383 |
| 3,713,587 | 1/1973 | Carson | 239/383 |
| 3,762,648 | 10/1973 | Deines et al. | 239/383 |
| 3,791,584 | 2/1974 | Drew et al. | 239/383 |
| 3,967,783 | 7/1976 | Halsted et al. | 239/102 |
| 4,079,891 | 3/1978 | Kwan | 239/101 |
| 4,131,233 | 12/1978 | Koenig | 239/381 |
| 4,274,595 | 6/1981 | Yamin | 239/383 |
| 4,657,185 | 4/1987 | Rundzaitis | 239/443 |
| 5,169,072 | 12/1992 | Gulyas | 239/240 X |

FOREIGN PATENT DOCUMENTS

| | | | |
|---|---|---|---|
| 2722967 | 8/1978 | Fed. Rep. of Germany | 239/383 |
| 2066704 | 7/1981 | United Kingdom | 239/383 |

*Primary Examiner*—Andres Kashnikow
*Assistant Examiner*—Lesley D. Morris
*Attorney, Agent, or Firm*—Dowell & Dowell

[57] ABSTRACT

Multi-functional showerheads which include a central water supply shaft along which an outer housing is selectively adjustable so that the showerheads are operable in a first mode wherein the housing rotates to provide a massage action and in a second mode to provide a fixed or rotary shower spray.

35 Claims, 7 Drawing Sheets

Fig. 1
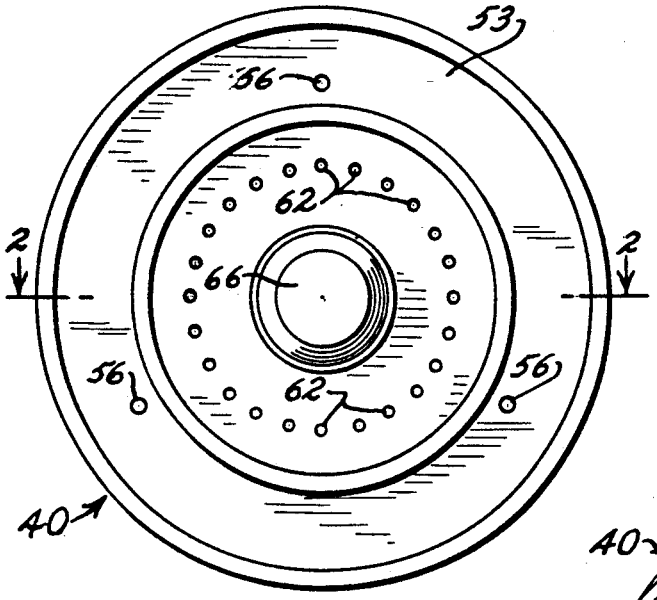
Fig. 3
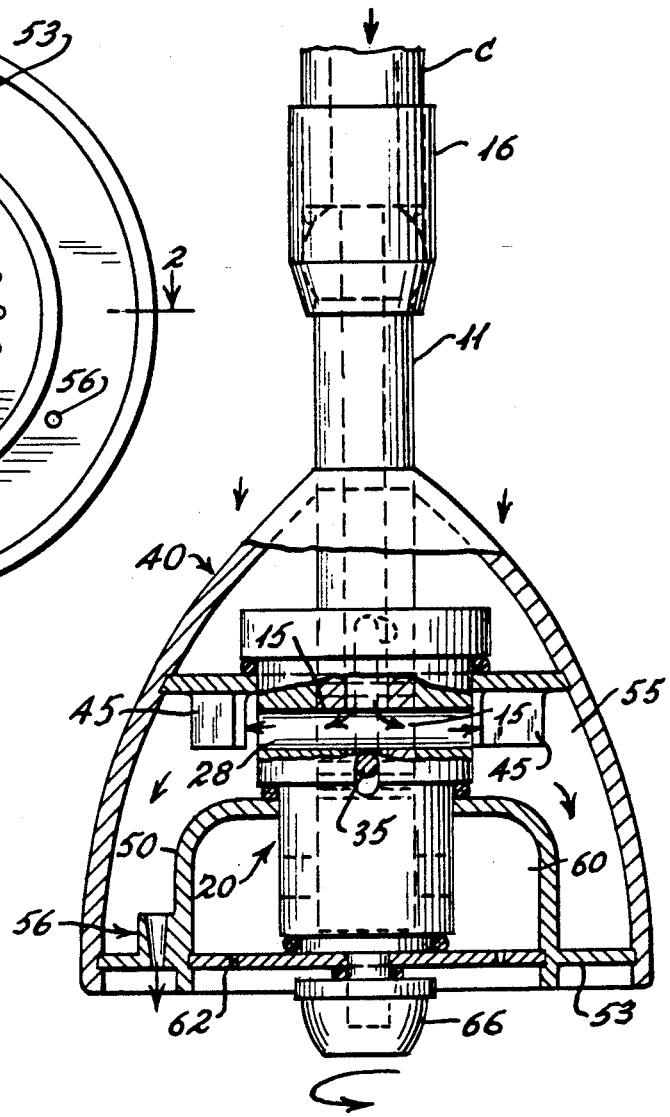
Fig. 6
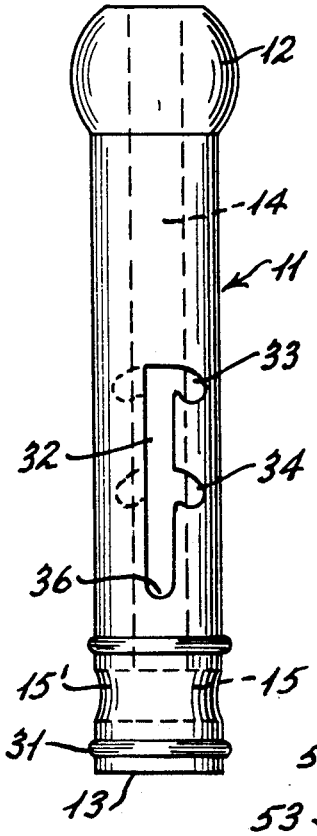
Fig. 8
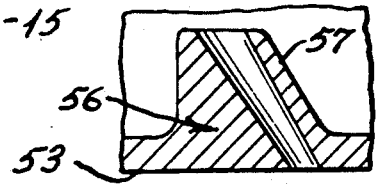
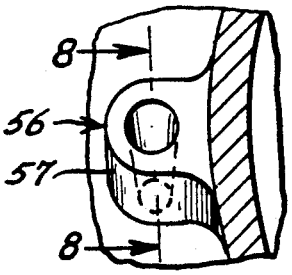
Fig. 7

ADJUSTABLE SHOWERHEAD ASSEMBLIES

CROSS REFERENCE TO RELATED APPLICATIONS

This application is a continuation-in-part application of a commonly assigned copending application entitled ADJUSTABLE SHOWERHEAD ASSEMBLY, filed May 22, 1992, as U.S. patent application Ser. No. 07/886,857, and now abandoned.

BACKGROUND OF THE INVENTION

1. Field of the Invention

This invention is generally directed to showerhead assemblies and, more specifically, to such assemblies that are operable in a push-pull manner to allow selective adjustment of the showerheads to obtain different operating or spray characteristics. The showerhead assemblies of the present invention are operable in a first mode to provide a whirling massage action where the fluid discharge nozzles are rotatably carried by an outer housing which rotates and a second mode wherein the other housing remains fixed or rotates to provide a more conventional shower spray.

In each embodiment of the present invention an impeller structure is provided within an outer housing which impeller is acted upon by fluid passing through the showerhead assembly so that a rotating action housing is achieved.

The impeller structures will vary between embodiments and will include, blades or turbine wheels, arcuate conduits and molded fluid conveying channels which are acted upon by water being conveyed through a supply shaft to a plurality of spaced discharge nozzles and openings. To allow a massaging action to be developed in instances of low water pressure, the discharge nozzles associated with the first mode of operation may be configured to converge inwardly from the interior of the outer housing toward the exterior thereof with such openings being angled so as to direct fluid outwardly at an angle with respect to the elongated axis of the showerhead to thereby create thrust in the direction of rotation initiated by the impeller structure. In addition, pressure regulatory valves control fluid flow through the showerhead assemblies.

In the second mode of operation, the outer housing of each showerhead assembly is shifted axially with respect to the central supply shaft so as to realign the central supply shaft with respect to the housing so that fluid flow is through a second chamber and therefrom through a spray plate mounted to the lower portion of the outer housing. In some embodiments, the outer housing will rotate with the central supply shaft and in other embodiments the outer housing rotates about a fixed central supply shaft when in the first mode of operation.

The showerhead assemblies may also include secondary impellers for creating rotation of the outer housings regardless of the spray mode selected.

2. History of the Related Art

Heretofore there have been a number of developments made in the construction of showerheads to allow the showerheads to operate in multi-functional modes so that water may be discharged not only in a conventional fixed spray pattern but discharged in a manner to promote a massaging action by either pulsating or whirling the water supplied through the showerhead. Unfortunately, many conventional showerheads which are designed to offer a massaging mode require complex internal components which must be sealed relative to one another. Most conventional massaging showerhead assemblies are relatively expensive to produce and due to the complexity of the components often do not operate in a manner which fully prevents leakage of fluid through the various components when the showerheads are in use. Also, such showerheads often do not function properly under conditions of low water supply pressure.

In one type of showerhead, the outlet or face is provided with a number of different orifices which may be rotated into alignment with the fluid supply channel through the showerhead assembly. In this manner, an individual selectively rotates the face plate of the assembly to align predetermined orifice configurations with the fluid supply in order to obtain different flow characteristics or spray patterns.

In somewhat related showerheads, as opposed to having a rotatable outer orifice or discharge plate, an interior valving plate, disk or series of disks are utilized to alter the flow through the showerhead to obtain either pulsating flow characteristics or to divert the flow of fluid through the showerhead to separately spaced orifices mounted in a fixed face plate.

In addition to the foregoing, other conventional showerheads have utilized impellers mounted within the showerhead to establish a pulsating or whirling effect of water being discharged therefrom. Generally, the impellers are mounted in the fluid supply path so that as the fluid passes through the showerhead, the impeller is rotated thereby effecting the pattern of fluid exiting the showerhead. In some of these showerheads a selector valve or plate may be included whereby the fluid flow may be directed away from the impeller through another fluid outlet. Some examples of prior art showerheads are disclosed in U.S. Pat. No. 2,622,927 to Sarbu, U.S. Pat. No. 3,485,451 to Gore et al., U.S. Pat. No. 3,713,587 to Carson, U.S. Pat. No. 3,762,648 to Deines et al., U.S. Pat. No. 3,967,783 to Holsted, U.S. Pat. No. 4,079,891 to Kwan, and U.S. Pat. No. 4,274,595 to Yamin.

SUMMARY OF THE INVENTION

This invention is generally directed to adjustable showerhead assemblies which are operable in different modes which may be selected by a push-pull action of the showerhead outer housing relative to a central water supply shaft. In each embodiment of the invention, the housing includes outer and inner chambers which are selectively aligned with spaced sets of upper and lower openings in a sleeve that surrounds the central supply shaft. Openings are also provided through the lower portion of the supply shaft so as to communicate with the main fluid passageway extending axially therethrough. Impeller structures are provided within the showerheads for initiating rotation of the outer housings. In some embodiments combinations of impellers may be utilized. The primary impellers are acted upon by fluid flowing through the openings in the sleeve. Secondary impellers are associated with the fluid supply shafts and are acted upon by fluid entering the supply shafts.

When the outer housing is pulled outwardly relative to the supply shaft the outer chamber or conduits therein will receive water being introduced through the upper openings in the sleeve. The water is conveyed toward a plurality of spaced discharge nozzles that are provided in the end or face plate of the outer housing and in some embodiments, the nozzles create additional thrust for rotation of the outer housing.

When the outer housings are pushed inwardly or upwardly relative to the supply shafts, the lateral openings of the supply shafts will align with the lower set of openings in the sleeves which communicate with the inner chambers. Fluid passes from the inner chambers through a plurality of spaced spray openings in the central portions of the end or face plates of the housings. In this mode, the housings may or may not rotate.

To facilitate the rotational movement of the outer housings in instances where there is lower water pressure, the discharge nozzles from the outer chambers may be tapered inwardly from the chamber toward the exterior or outlet openings and are elongated and angled so that water being discharged therethrough is exhausted at an angle relative to the elongated axes of the showerheads to thereby cause thrust in a direction of the rotation of the showerheads.

In one embodiment, the outer housing is rotatable with respect to the central supply shaft and surrounding sleeve when in the first or whirling massage mode. In this embodiment, the impeller is formed as a turbine wheel having a plurality of angled blades which are impacted by water being introduced into the outer chamber. The turbine wheel is fixedly mounted to the outer housing and rotates therewith about the sleeve when the showerhead is operated in the whirling mode. In this embodiment, the sleeve is keyed to the central supply shaft by pins carried by the sleeve which extend in grooves made in the outer surface and along a portion of the length of the supply shaft. A pair of laterally extending recesses are formed in communication with the elongated grooves, one adjacent the upper portion thereof and one adjacent the intermediate portion thereof, in which the pins may be selectively seated when the sleeve is rotated slightly with respect to the shaft. In this manner, the sleeve may be locked in selected operational alignment with respect to the supply shaft. In the uppermost position, the fluid is directed into the inner chamber through the lower openings in the sleeve, whereas in the lowermost position, the fluid is directed into the outer chamber through the uppermost set of openings in the sleeve. When the sleeve is seated with the pins carried thereby within the intermediate recesses, fluid flow from the central shaft is partially interrupted as the lateral passageway therein is not aligned with any outlet opening into either the outer or inner chambers and is partially sealed by appropriate O-rings carried by the central shaft.

In alternate embodiments, the central supply shaft rotates freely within a stationary collar which is mounted to a conduit associated with a conventional water supply system. The sleeve which is mounted in surrounding relationship with respect to the central shaft is selectively slidable along the length of the shaft but retained so that the sleeve does not rotate relative to the shaft. In these embodiments, when fluid is directed through the supply shaft and the upper set of openings in the sleeve, the fluid is directed toward the discharge nozzles associated with the outer chamber either directly or by the impeller structures which assist in rotating the outer housing, sleeve and central supply shaft relative to the collar. By sliding the sleeve axially of the central supply shaft, the lateral openings in the central supply shaft may be realigned from the upper openings in the sleeve toward the lower openings therein, wherein fluid is directed into the inner chamber to be discharged through the set of spray orifices associated therewith. In these embodiments, the frictional engagement of the sleeve about the shaft allows the sleeve to be retained in a selected operational alignment with respect to the supply shaft.

To rotatably support the supply shaft relative to the collar, the shaft includes an upper annular flange which is seated on an O-ring fitted within an annular counterbore formed in the collar. To further reduce and facilitate the rotation of the supply shaft within the collar, the supply shaft may be suspended by a swivel from a ball joint or adapter by way of which the showerhead is mounted to a conventional source of water supply.

Also, to regulate pressures and to conserve water usage, a flow control valve may be incorporated with the showerheads of the present invention. The valve is progressively closed as water supply pressure increases to thereby regulate pressure through the showerhead to between predetermined limits.

Further, in these embodiments, rotation of the outer housing in the massage mode may be created or assisted by impellers associated with the supply shaft or sleeve or combination of both. In some instances, an impeller incorporating a plurality of radially extending blades will be formed along the upper end of the supply shaft extending outwardly of the annular flange which support the shaft within the collar. A flow diverter assembly is mounted above and in surrounding relationship to the shaft impeller. A valve is mounted within the flow diverter and is generally in a first position to establish flow directly through the central passageway of the supply shaft and in a second position to channel flow toward the shaft impeller after which the fluid is conveyed into the central passageway of the supply shaft. When the shaft impeller is used, the outer housing of the showerhead assemblies will rotate in both the massage and spray modes. The primary impellers are associated with the sleeve in which the supply shaft is mounted. These impellers which are disposed within the outer chamber may include impeller blades, conduits or channels mounted to, or molded with, the sleeve and which direct or convey fluid from the upper set of openings in the sleeve toward the discharge nozzles.

As an additional feature, rotation of the supply shaft may be further aided by rifling the inner walls defining the fluid passageway therethrough. By forming one or more spiral grooves, or ribs, within the supply shaft, fluid passing through the shaft will be directed in a spiral motion thereby providing additional rotational thrust for the showerhead housing.

It is the primary object of the present invention to provide multi-functional showerhead assemblies which are operable in a first mode to create a whirling massaging shower action in which the housings of the showerheads rotate either on or with the central water supply shafts of the assemblies and wherein by a simple pushing movement of the housings upwardly relative to the central supply shafts, the water flow through the assemblies may be changed to a more conventional spray pattern.

It is a further object of the present invention to provide a showerhead assembly which is particularly adaptable for creating a massaging action even in those instances where the fluid supply pressure to the showerhead is at a minimum.

It is also an object of the present invention to provide an economical construction for multi-functional showerhead assemblies wherein fluid passing through the showerheads may be interrupted by a linear adjustment to the showerhead housings relative to central water supply shafts whereby fluid flow may be terminated or partially interrupted without having to adjust the hot and cold water supplies and whereupon selective movement of the showerhead housing when fluid supply is to be fully reinitiated results in fluid being supplied at a temperature which was previously selected.

It is a further object in some of the embodiments of the present invention to provide multi-functional showerhead assemblies wherein each of the components of the assemblies may be easily assembled with respect to one another, with the impeller structure, and secondary housing components being snap-fitted, spin welded or otherwise sealed with respect to the outer housings.

It is also an object of the present invention to provide adjustable showerhead assemblies which are adjusted by simply pushing and pulling the showerhead housings along the axes of the water supply shafts.

It is yet another object of other embodiments of the present invention to provide multi-functional showerhead assemblies wherein either one or more impellers may be used alone or in combination with specially designed discharge nozzles to obtain a unique rotary massaging action of fluid even under conditions of low water pressure.

It is also an object of the present invention to provide multi-functional showerhead assemblies wherein the water supply therethrough is regulated to preserve water resources without adversely affecting the operational characteristics thereof.

BRIEF DESCRIPTION OF THE DRAWINGS

FIG. 1 is a bottom plan view of the two sets of discharge orifices associated with the showerhead assemblies of the present invention.

FIG. 3 is a cross-sectional view similar to FIG. 2 showing the housing and inner sleeve shifted relative to the support shaft so as to cause flow to be through the outer chamber as indicated by the arrows in the drawing figure. In this mode of operation the showerhead rotates so as to create a whirling massaging action.

FIG. 6 is a front plan view of the central supply shaft of the embodiment of FIGS. 1-4 showing the key slot or groove formed therein in which the locking pins associated with the sleeve are selectively guided.

FIG. 7 is an enlarged cross-sectional view taken along lines 7—7 of FIG. 2 showing the angled relationship of the discharge nozzles associated with the outer chamber.

FIG. 8 is a cross-sectional view taken along lines 8—8 of FIG. 7 further illustrating the tapered discharge nozzles associated with the outer chamber.

DESCRIPTION OF THE PREFERRED EMBODIMENTS

Figure 2:
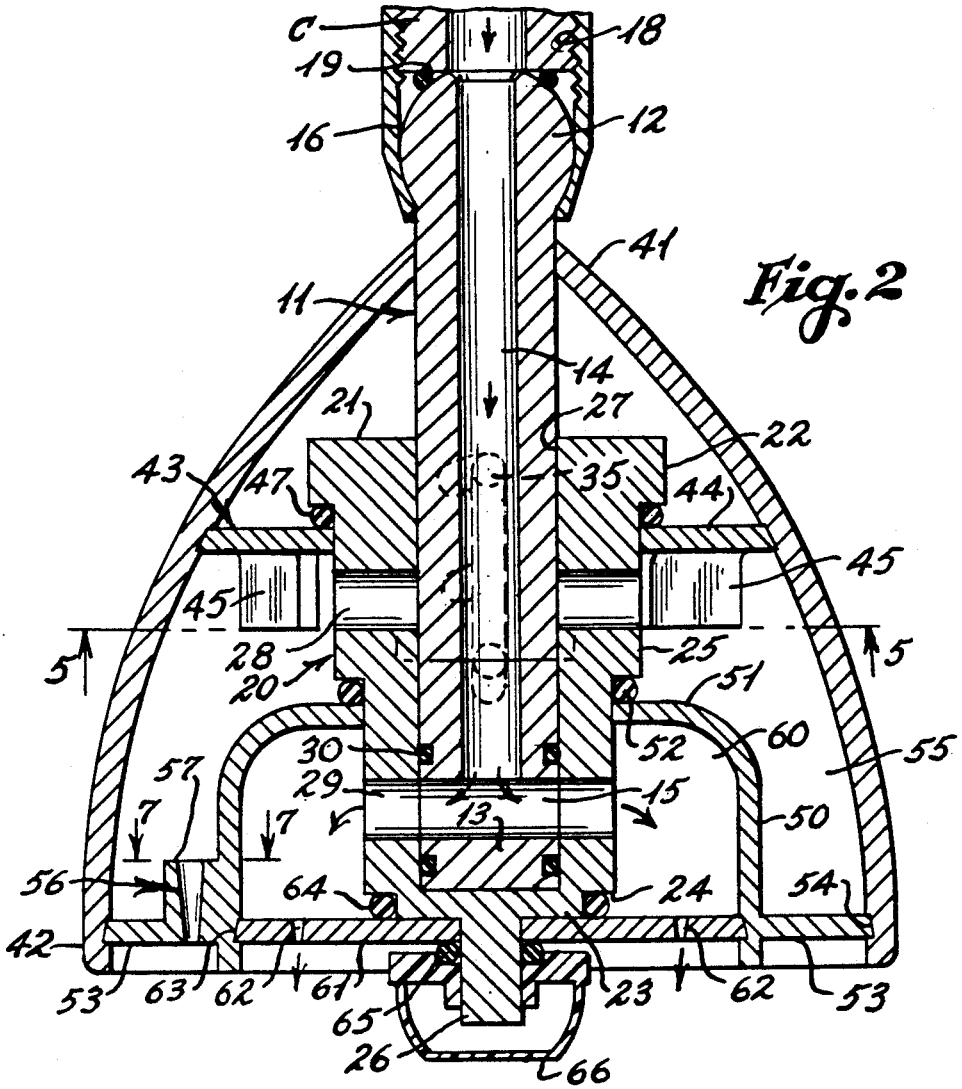
FIG. 2 is a cross section taken along lines 2—2 of FIG. 1 wherein the outer housing and an inner sleeve are aligned relative to the central supply shaft so as to permit fluid flow through an inner chamber as indicated by the arrows therein so as to create a conventional spray pattern.

With continued reference to the FIGS. 1-8 of the drawings, a first embodiment of a adjustable showerhead assembly 10 of the present invention will be described as it is constructed to be mounted to a conventional shower conduit or nipple C, so as to receive hot and cold water through conventional valves or mixing valves, not shown. The assembly includes a central elongated fluid supply shaft 11 which is generally circular in cross section and which includes an integrally formed bulbous upper end portion 12 and a generally cylindrical lower end portion 13. The shaft 11 is provided with an elongated fluid passageway 14 which extends from the upper end toward the lower end thereof and which communicates with lateral passageways 15 opening to an annular recess 15 (see FIG. 6) in the shaft. The shaft 11 is pivotally mounted relative to the conventional conduit outlet C by means of a coupling member 16 having an inwardly bevelled base portion 17 in which the upper bulbous end portion 12 of the shaft is seated. The coupling member includes threads 18 which are engaged with the threaded end portion of the conduit C. The conduit C is sealed with respect to the passageway 14 by means of an O-ring 19.

The showerhead assembly 10 further includes an inner sleeve 20, having an upper end portion 21 which includes an outwardly extending flange 22 and a lower end portion 23 having an outwardly extending flange 24. The sleeve is generally circular in cross section with the diameter adjacent the upper end portion 21 being greater than the diameter adjacent the lower portion 23. An intermediate flange 25 is provided for purposes of which will be discussed in greater detail hereinafter. The sleeve further includes an outwardly extending spindle 26.

Figure 4:
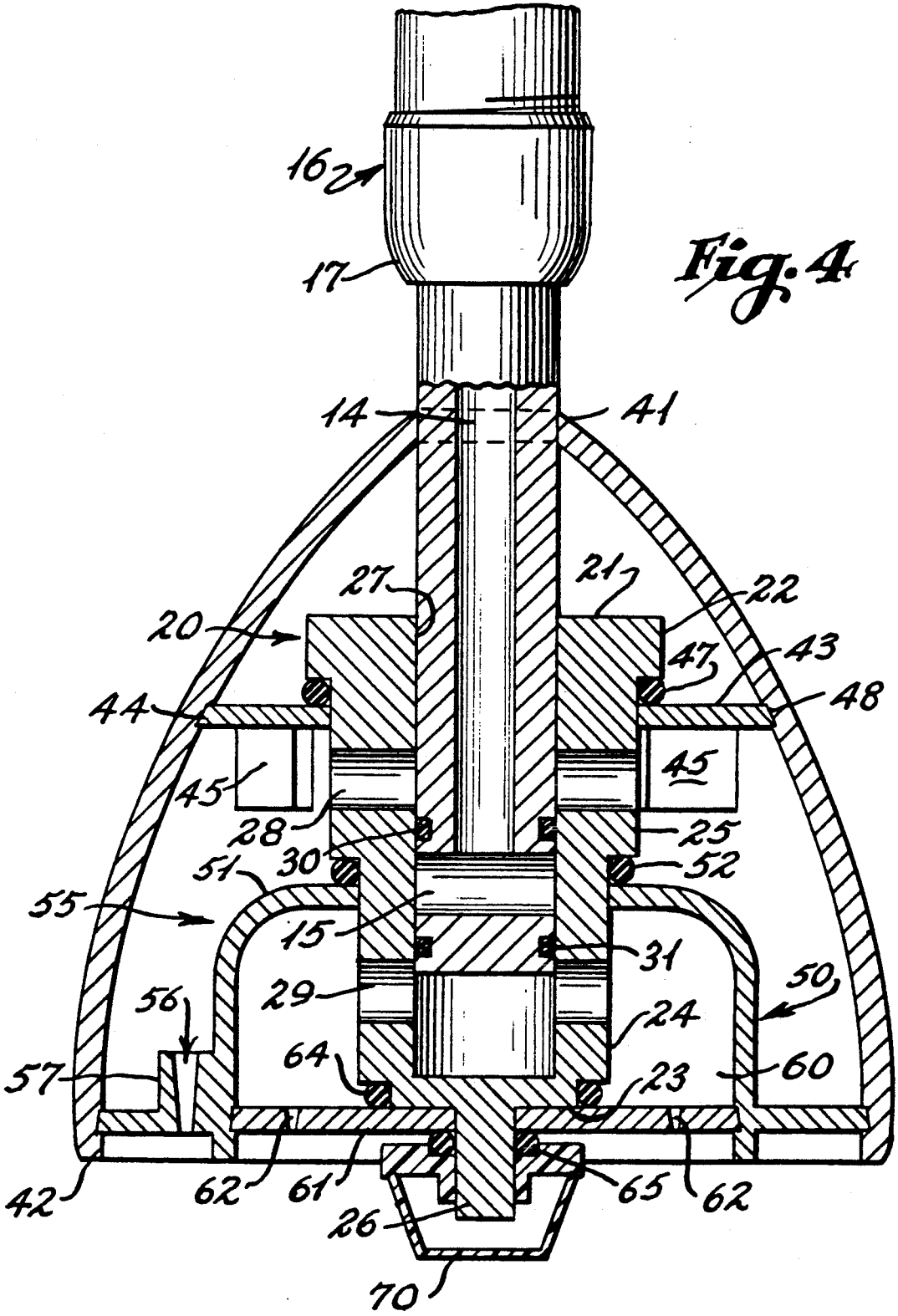
FIG. 4 is a cross-sectional view similar to FIG. 2 showing the outer housing and sleeve shifted relative to the supply shaft so as to substantially and temporarily interrupt flow through the showerhead.

The sleeve 20 is provided with a cavity 27 which is of a diameter to frictionally receive the shaft 11, as is shown in FIGS. 2 and 4. The cavity extends from the upper portion 21 toward, but spaced from, the lower portion 23. The sleeve further includes a plurality of upper and lower openings 28 and 29 which may be selectively aligned with the recess 15' of the shaft 11. In this respect, FIG. 2 shows the openings 29 aligned with the lateral passageways 15 and recess 15' when the sleeve is oriented in a first position with respect to the shaft 11, and FIG. 3 shows the openings 28 aligned with the lateral passageways 15 and recess 15' with the sleeve in a second orientation or position with respect to the shaft 11. In order to substantially seal the recess 15' with respect to either set of openings 28 or 29, a pair of O-rings 30 and 31 are mounted on either side thereof.

From the foregoing, the operation and control of the adjustable showerhead assembly of this embodiment and the other embodiments of the present invention relates to the relative positioning of the sleeve 20 with respect to the shaft 11. To positively guide the sleeve 20 with respect to the shaft 11, a pair of elongated grooves 32 are provided on opposite sides of the shaft, as shown in FIG. 6. Each groove has an offset recess 33 provided in communication therewith along the upper portion thereof and a recess 34 communicating with the intermediate portion thereof. These recesses provided seats in which a pair of locking pins 35 may be selectively engaged in order to retain the sleeve in an adjusted position relative to the shaft 11. The pins 35 are mounted within openings provided in the sleeve and serve to guide the sleeve along the grooves 32 and prevent the rotation of the sleeve 20 relative to the shaft 11 while limiting the axial movement of the sleeve 20 between the upper and lower portions of the grooves 32. In FIG. 2, the sleeve 20 is shown with the pins 35 being oriented adjacent the upper portion of the grooves 32 wherein they are seated within the offset recesses 33 so that the lateral passageways 15 and recess 15' in the shaft 11 are aligned with the openings 29 in the sleeve. In FIG. 3, the sleeve has been slightly rotated to release or disengage the pins 35 from the recesses 33 and the sleeve has thereafter been moved to the lower portion 36 of the grooves 32 wherein the recess 15' of the shaft 11 is aligned with the openings 28 in the sleeve.

The sleeve 20 may also be moved to a position intermediate the upper and lower portions of the grooves 32 wherein the guide pins 35 may be slightly rotated and seated within the recesses 34. In this position, the recess 15' will be spaced intermediate or between the sleeve openings 28 and 29 and sealed with respect to the sleeve by the O-rings 30 and 31. In this position, little or no flow of fluid from the conduit C is allowed to pass from the shaft 11.

Although it is possible to terminate flow through the showerhead by positioning the sleeve as shown in FIG. 4, because of safety reasons, it is preferred to allow a partial flow through to the openings 29 when the sleeve is in the intermediate position. In this case one or more bleed channels 29' are formed inwardly of the inner cavity 27 which communicate with the openings 29. With this structure, a temporary substantial termination of flow is possible, however, sufficient flow is retained to prevent accidental scalding.

Figure 5:
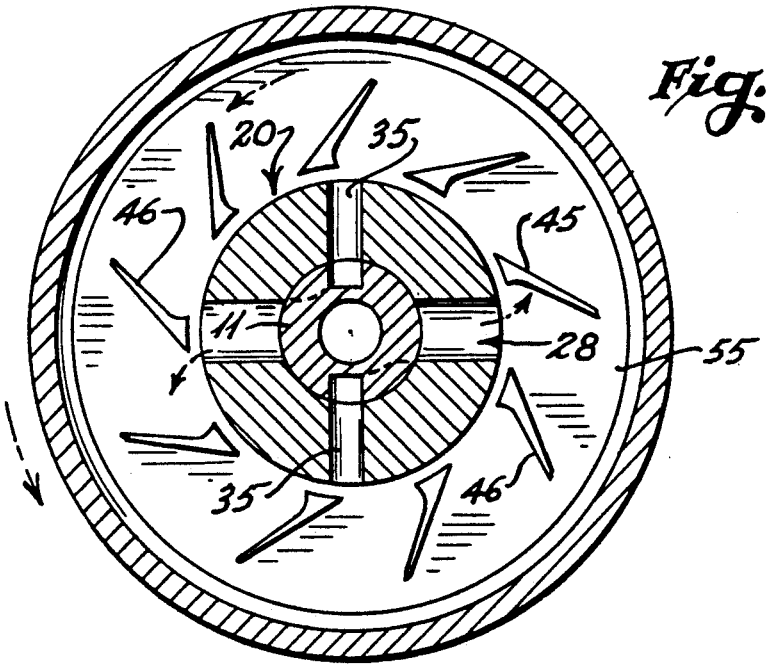
FIG. 5 is a cross-sectional view taken along lines 5—5 of FIG. 2 showing the orientation of the impeller blades and the keyed locking arrangement between the sleeve and central supply shaft of this embodiment of the present invention.

The adjustable showerhead assembly 10 is further provided with an outer bell-shaped housing 40 which includes an upper end portion 41 having a circular opening therein of a size to permit the shaft 11 to be inserted therethrough and a lower end 42. The outer housing 40 of this embodiment is freely rotatable with respect to the shaft 11 and is therefore not positively fixed thereto. In some instances, a slight clearance may be provided between the shaft 11 and opening defined in the upper portion 41 of the housing. Mounted interiorly of the housing and generally intermediate the length thereof is a turbine-like impeller 43 which is defined by an annular plate 44 having a plurality of blades 45 extending downwardly therefrom. The blades are oriented at an angle relative to radial lines extending from the central axis of the shaft 11 so that the trailing surfaces 46 of each blade will be impacted by the fluid flow exiting through the openings 28 in the sleeve 20, as is shown in FIG. 5. The angle of inclination of the blades may be varied. Further, it is shown that the blades are tapered from their inner ends inwardly towards the outer ends thereof to facilitate the dynamics of the structure in use.

The fluid impeller 43 is rotatable with respect to the sleeve 20 and, in this regard, includes a central opening through which the sleeve extends. The sleeve is retained in fluid tight relationship with respect to the impeller by providing an annular O-ring 47 between the sleeve flange 22 and the plate 44 of the impeller. The impeller is further fixed to the housing 40 by providing an undercut annular groove 48 in the inner wall of the outer housing in which the plate 44 of the impeller 43 is snap-fitted, welded or otherwise secured.

Mounted inwardly of the housing and intermediate the impeller 43 and lower end 42 of the housing is an inner or secondary housing 50 which includes an upper or inner end portion 51 having an annular opening therethrough through which the sleeve 20 extends as is shown in FIGS. 2-4. As with the impeller 43, the secondary housing 50 is rotatable with respect to the sleeve 20 and is sealed in fluid tight relationship with respect to the flange 25 thereof by way of an O-ring 52. The lower or outer end portion of the inner or secondary housing 50 includes an annular flange 53 which is snap-fitted at its outermost portion into an annular undercut groove 54 provided in the outer housing adjacent the lower portion 42 thereof. Due to the engagement of the flange 53 within the annular groove 54, the inner housing 50 will rotate simultaneously with the outer housing about the sleeve 20.

A first or outer chamber 55 is defined between the inner and outer housings 50 and 40 through which fluid is received through openings 28 when the recess 15' is aligned with the openings. The fluid impinges upon the impeller blades 45 and thereafter is directed to a plurality of discharge nozzles 56 formed within the flange 53 of the inner housing 50. The discharge nozzles 56 create a thrust to assist in the rotation developed by the impeller 43. As shown in FIGS. 2–4, 7 and 8, each discharge nozzle 56 extends through an upstanding lug 57 integrally formed with the inner housing. The inner portion of the nozzles 56 adjacent the top of the lugs 57 is shown as being of a greater diameter than the exit portion of the nozzles adjacent the lower portion of the housing. In this manner, the nozzles 56 are tapered inwardly from their uppermost portion to their lowermost portion to thereby assist in creating a thrust action of the water passing therethrough. Further, as shown in FIGS. 7 and 8, the nozzles 56 are angled relative to the elongated axis of the shaft 11 so that water discharging therefrom will be in a direction opposite the direction of rotation of the outer housing 40.

In the drawing figures and as shown in FIG. 1, only three rotating discharge nozzles 56 are provided. In some instances, differing number of nozzles may be utilized and be within the teachings of the present invention.

Defined between the lower portion of the sleeve 20 and the inner housing 50 is a second or inner chamber 60. The second fluid chamber receives fluid discharged through the openings 29 of the sleeve when the recess 15' of the shaft 11 is aligned therewith. The chamber 60 is closed by a spray plate 61 having a plurality of annularly spaced discharge openings 62 therethrough. As shown in FIGS. 2–4 the openings 62 are tapered inwardly from the inner portion to the outer portion of the plate. The plate 61 is snap-fitted within an undercut annular groove 63 formed in the inner wall of the housing 50. To prevent fluid from seeping from the chamber 60 along the spindle 26 a pair of spaced O-rings 64 and 65 are provided within the chamber 60 adjacent the flange 24 of the sleeve 20 and along the exterior of the plate 61 and about the spindle 26.

To assist in the manual manipulation and sliding of the housings and sleeve with respect to the shaft 11, a control knob 66 is secured to the spindle 26. In this manner, the knob 66 does not rotate and is fixed to the sleeve 20 so that the knob may be easily engaged even when the assembly is in a rotational mode.

With continued reference to FIGS. 9–14 of the drawings, a second embodiment of adjustable showerhead assembly 70 of the present invention will be described as it is constructed to be mounted to a conventional shower conduit or nipple. The assembly 70 includes a central elongated fluid supply shaft 71 which is generally circular in cross section and which is free to rotate within an upper collar 72. The upper portion of the shaft has an annular flange 73 which rides on an O-ring 74 and a generally cylindrical lower end portion 75.

The supply shaft 71 is provided with an elongated fluid passageway 76 which extends from the upper end toward the lower end thereof and which communicates with lateral openings or passageways which communicate with an annular recess 77 in the shaft. The collar 72 is mounted to a spherical adapter 78 which is pivotally mounted relative to the conventional conduit outlet by a coupling 79. The coupling 79 includes an inwardly bevelled base portion 80 in which the bulbous end 81 of the adapter 78 is seated. A conduit is sealed with respect to a passageway through the adapter by an O-ring 83.

The adapter 78 further includes a base 84 which is secured within an upper annular recess 85 of the collar 72 so that the passageway 82 therethrough aligns with the elongated fluid passageway 76 through the supply shaft 71. The annular recess 85 is vertically spaced relative to a lower annular recess 86 formed in the collar 72 in which the O-ring 74 is seated by a distance sufficient to permit the annular flange 73 of the supply shaft 71 to be rotatable beneath the base 84 of the adapter.

Figure 9:
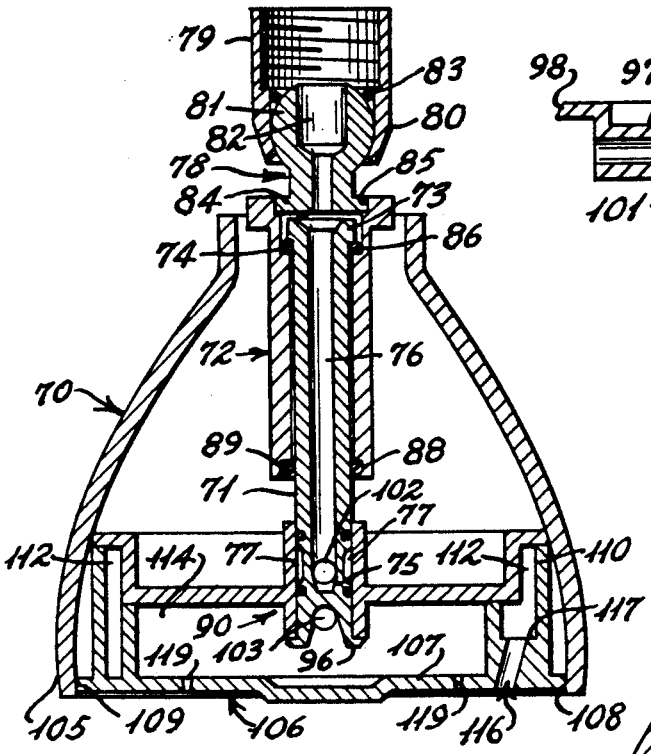
FIG. 9 is a cross-sectional view taken through a second embodiment of the present invention wherein the sleeve and control supply shaft are rotatable with the outer housing and suspended from a support collar. In this design, flow is through the outer chamber creating a whirling massage action.
Figure 10:
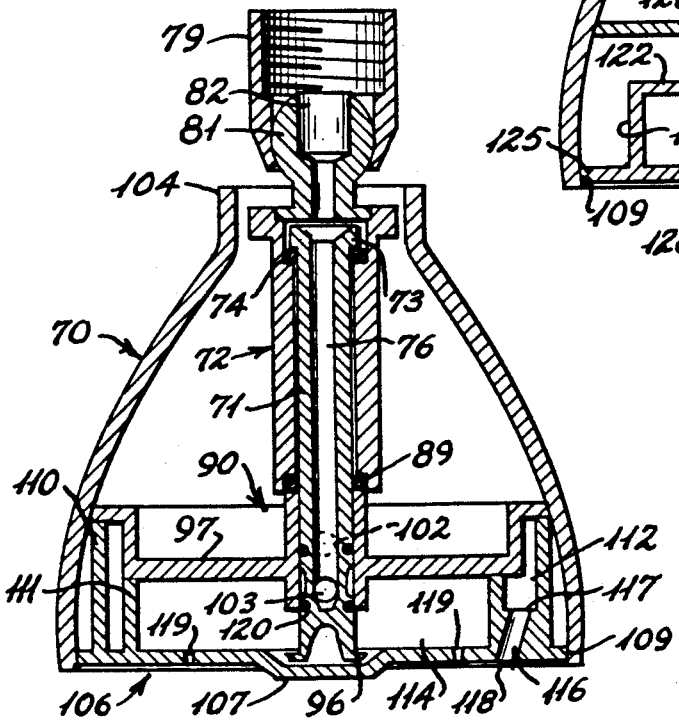
FIG. 10 is a cross-sectional view similar to that of FIG. 9 showing the outer housing and sleeve pushed inwardly of the supply shaft to establish a fixed conventional spray through the inner chamber.

The collar 72 further includes an elongated tubular shank 87 and a lower recess 88 in which is seated another O-ring 89 which is used to stabilize the supply shaft 71 as it rotates. As shown in FIGS. 9 and 10, the lower end of the supply shaft 71 extends below the lower end of the collar.

The showerhead assembly 70 has an inner sleeve 90 having a tubular body portion 91 having upper and lower ends 92 and 93, respectively. The body portion defines an open cavity 94 of circular cross section of sufficient size to permit the lower end portion of the supply shaft 71 to be slideably and frictionally received therein.

A pair of snap fingers or projections 96 which extend out from and are integrally molded with the supply shaft 71 engage the lower end of the sleeve to prevent withdrawal of the shaft from the sleeve. The sleeve is vertically adjustable along a portion of the length of the shaft. The positioning relative to the shaft 71 being limited by the collar 72. It should be noted that, as opposed to the engagement shown in FIGS. 9 and 10 other connectors could be used.

Figure 11:
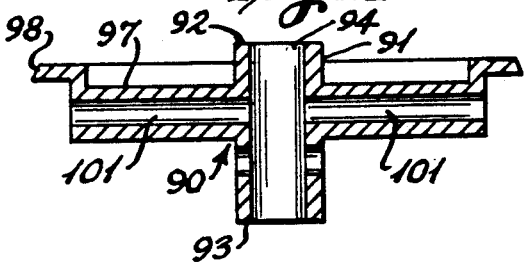
FIG. 11 is a cross-sectional view of the sleeve of the embodiment shown in FIGS. 9 and 10 showing the molded fluid impeller conduits integrally formed therewith.

The sleeve is molded with an annular hub 97 which extends outwardly and upwardly to an annular flange 98 which is fixedly engaged to an outer bell-shaped housing 100. As shown in FIG. 11, below the hub 97 are molded a plurality of impeller channels 101 which communicate with openings 102 into the cavity 94 of the sleeve and terminate in spaced relationship from the inner walls of the outer housing 100. Although the channels are shown as extending generally straight radially outwardly of the body portion 91 of the sleeve 90, in some instances the channels may be arcuately configured and elongated toward the enlarged end of the outer housing to vary the thrust created by fluid being conveyed therethrough and discharged therefrom. The sleeve also includes a lower set of openings 103 which are spaced from the upper set for purposes which will be discussed herein below.

The outer bell-shaped housing 100 includes an upper end portion 104 having a circular opening therein of a size to permit the collar 72 and shaft 71 to be inserted therethrough and an enlarged lower end 105. The outer housing is designed to be freely rotatable with respect to the collar 72 and is therefore not mounted thereto. A slight clearance is provided between the collar 72 and an opening defined in the upper portion 104 of the housing. Mounted interiorly of the housing and generally intermediate the length thereof is the sleeve 90 which is fixed to the housing by the annular flange 98.

Mounted in the lower end 105 of the housing below the sleeve 90 is an inner or secondary housing 106. The secondary housing includes a face plate 107 having an annular flange 108 which is snap-fitted into an annular undercut groove 109 provided in the outer housing adjacent the lower end 105. Due to the engagement of the flange 108 within the annular grove 109, the inner housing 106 will rotate with the outer housing about the collar 72.

The inner housing 106 also includes a pair of inwardly extending annular walls 110 and 111 which are engagable with the annular hub 97 and the flange 98, respectively, of the sleeve 90 so as to create a first or outer chamber 112 and a second inner chamber 114. When the outer housing 100 is fully extended downwardly with respect to the collar 72 as shown in FIG. 9, the upper openings 102 in the sleeve 90 will align with the impeller channels 101 (see FIG. 11) which are situated within the outer chamber 112. In this position, fluid flow through the passageway 76 and recess 77 of the supply shaft 71 is directed into chamber 112. However, when the outer housing is pushed upwardly relative to the collar 72, as is shown in FIG. 10, the lower openings 103 in the sleeve 90 will be in open communication with the inner chamber 114 thereby providing fluid flow from the inner passageway 76 and recess 77 of the supply shaft 71 into chamber 114.

A plurality of discharge nozzles 116 are formed within the flange 108 of the inner housing 106 which communicate with the outer chamber 112. As with the first embodiment, the nozzles are specifically designed to create a thrust to assist in the rotation of the inner and outer housings 106 and 100 to establish a whirling massaging spray. In this respect, and as shown in FIGS. 9 and 10, each discharge nozzle 116 extends through an upstanding flange 117 integrally formed with the inner housing. The inner portion of the nozzles adjacent the top of the flange 117 are of a greater diameter than the exit openings 118 through the face plate 107. In this manner, the nozzles 116 are tapered inwardly from their uppermost portion to their lowermost portion to thereby assist in creating a thrust action of the water passing therethrough.

Further, as with the previous embodiment, the nozzles are angled relative to the elongated axis of the shaft 71 so that water discharging therefrom will be in a direction opposite the direction of rotation of the outer housing 100 relative to the collar 72 and generally tangential to the axis of rotation. In this manner, the thrust of the fluid discharging through the openings 116 will assist the impeller channels 101 in rotating the components of the showerhead assembly relative to the collar 72. Generally, at least three discharge nozzles are provided.

When the showerhead assembly 70 is operated to provide a conventional spray, as shown in FIG. 10, the water in the inner chamber 114 will be discharged to a plurality of spaced tapered openings or orifices 119 provided in the central portion of the face plate 107.

In order to prevent any leakage between the inner and outer chambers and to retain the supply shaft in selected alignment with the sleeve, a pair of O-rings 120 are seated in annular grooves formed spaced from the lower end of the supply shaft 71. By appropriate dimensioning, this embodiment may also be disengaged to operate in an intermediate semi-off mode so as to allow temporary limited fluid flow through the showerhead.

Figure 12:
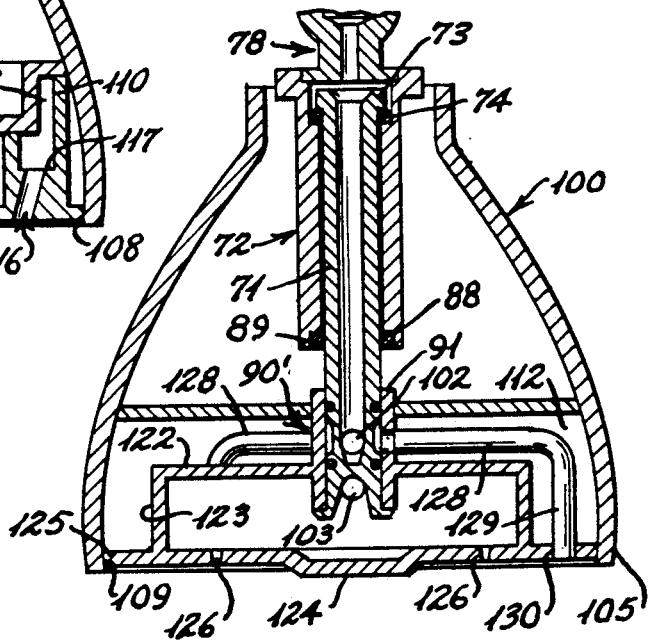
FIG. 12 is a cross-sectional view of another embodiment of the present invention wherein the impeller associated with the outer chamber is formed of a plurality of arcuate conduits.

With particular reference to FIG. 12, another embodiment of the present invention is shown in detail. This embodiment is also designed to allow the outer housing and supply shaft to rotate relative to the support collar and the same reference numbers are utilized to identify the same components. In this embodiment, however, a modification has been made to the sleeve, impeller structure and inner housing. The sleeve 90' includes the same cylindrical body 91, central cavity 94, and upper and lower passageways 102 and 103, however, the sleeve and inner housing have been combined. The inner housing is now defined by a radially extending wall 122 and outwardly directed annular flange 123. A face plate 124 is integrally formed with the sleeve and includes an outer annular edge 125 which is engagable within the groove 109 formed in the end 105 of the housing 100.

Figure 13:
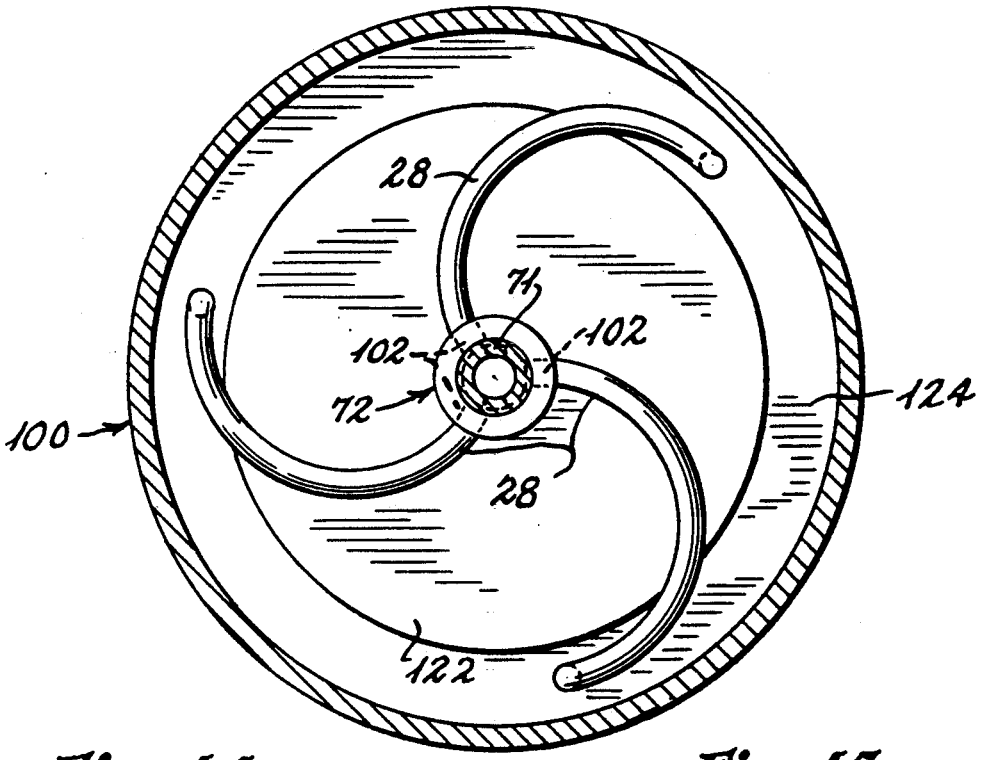
FIG. 13 is a top plan view of the conduits shown in FIG. 12.

The wall 122 and flange 123 divide the main portion of the housing into outer and inner chambers 112 and 114, respectively. Fluid flow through the inner chamber is through a plurality of orifices 126 in the central portion of the face plate 124. Fluid flow through the outer chamber, however, is now provided through arcuately configured impeller conduits or hoses 128 having their inner ends mounted within or formed with the upper openings 102 of the sleeve and their outer ends 129 mounted in or formed with tapered nozzle openings 130 through the outer periphery of the face plate. The shape of the conduits creates an initial thrust or force for rotating the outer housing 100 and supply shaft 71 about the collar 72. The outer end 129 of the conduits are also turned inwardly and are angled so as to direct flow in a direction opposite to the rotation of the housing to thereby further develop rotational thrust. Normally, three or more conduits are used, as shown in FIG. 13.

Figure 14:
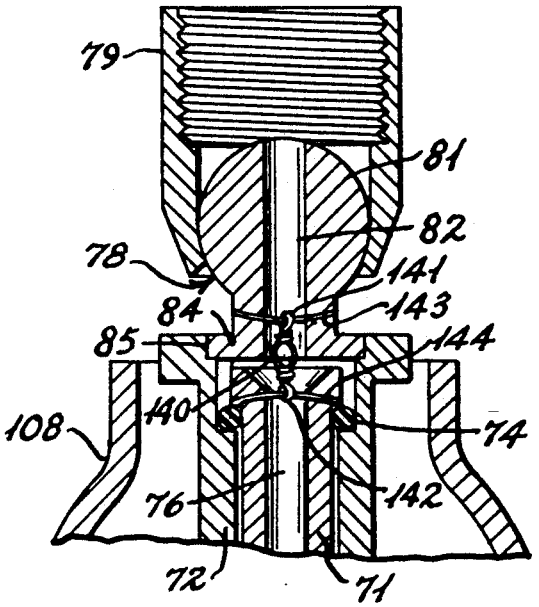
FIG. 14 is an enlarged cross-sectional view of an adapter assembly for rotatably supporting the supply shafts of the embodiments of the invention shown in FIGS. 9-13.

To additionally facilitate the whirling mode of operation of the embodiments shown in FIGS. 9-13 wherein the outer housing 100 and supply shaft rotate about the collar 72 by the annular flange 73 riding on the O-ring 74, a substantial portion of the weight of the rotating components of the showerhead and the fluid passing therethrough may be offset by at least partially suspending the supply shaft 71 from the adaptor 78. With reference to FIG. 14, a conventional swivel 140 having upper and lower eyelets 141 and 142, may be connected by wires 143 and 144 which are anchored with the side walls of the adaptor and supply shaft in such a manner that only sufficient contact pressure is retained between the O-ring 74 and flange 73 of the supply shaft to form a liquid tight seal. The swivel is oriented within the passageway but will not adversely effect the flow of water therethrough.

The showerhead assemblies of the present invention may also be modified so as to preserve water resources and yet permit proper functioning thereof in both the whirling massage and fixed spray modes. With particular references to FIGS. 15 and 16, the adaptor 78 may be provided with a pressure regulator 150 which is seated within a counterbore 151 formed in the passageway 82. The regulator includes a valve 152 having a stem 153 supported within a spring element 154. The counterbore includes an annular valve seat 155 surrounding the spring element 154. A plurality of openings 156 are provided in the peripheral edge of the valve head so as to permit flow therethrough. As pressure on the valve is increased, the valve stem will be urged into the passageway 82 against the action of spring element 154 thereby restricting, but not terminating fluid flow. If excessive pressures are encountered, the valve will abut valve seat 155. However, the openings 156 are not fully obstructed by the valve seat so the flow is only regulated and not terminated. The regulator be adjusted to maintain pressures between predetermined limits.

With reference to FIG. 17-21, another variation which may be incorporated with the embodiments shown in FIGS. 9-16 is disclosed for developing additional rotational thrust on the central supply shaft 71. In this embodiment the upper end of the central supply shaft has been modified to function as an alternate or secondary impeller. A plurality of impeller blades 160 are provided in generally equally spaced relationship extending radially outwardly from the upper end portion of the supply shaft. The supply shaft continues to be mounted on a O-ring 74 by the annular flange 73 associated therewith. The recess within the upper portion of the collar has been enlarged over the previous embodiments so as to provide sufficient room for receiving a diverter assembly 162 which is used to convey fluid either directly through a central channel 163 associated therewith to the central elongated passageway 76 of the supply shaft or through supplemental fluid channels 164 which terminate in lower openings 165 which are angled so as to direct fluid against the blades 160 of the shaft impeller. A plurality of such auxiliary passageways 164 are provided with the openings 165 being generally equally spaced about the periphery of the impeller. The diverter assembly 162 is retained within the recess of the collar 72 by the base 84 of an adapter 78 similar to that discussed with respect to the embodiments of FIGS. 9, 10 and 12.

A valve 166 extends through the collar 72 and a portion of the diverter assembly 162 and is used to control or direct flow either through the central channel 163 of the diverter or the auxiliary channels 164. One type of valve 166 is disclosed in greater detail in FIG. 21. The valve includes an elongated shank 167 which is generally circular in cross section and which is situated in an appropriate opening made within the diverter 162 and collar 72. Intermediate the length of the shank 167 is a through hole 168 which when aligned with the channel 163 permits fluid flow directly into the central passageway 76 of the supply shaft 71. However, when the shank 167 is shifted laterally a half-slot 169 aligns with the fluid passageway 82 through the adapter 78 and serves to divert the fluid flow therethrough through radially extending fluid passageways 170 formed intermediate the base 84 of the adapter 78 and the upper surface of the diverter 162. Thereafter the fluid is directed downwardly through the auxiliary channels 164 where the fluid is directed outwardly through openings 165 which are oriented generally tangentially to the central axis of the supply shaft as is shown in greater detail in FIG. 19. In this manner the fluid is directed against the impeller blades 160 causing a rotation of the supply shaft 71. A pair of spaced O-rings 171 are utilized to seal the valve shank 167 relative to the opening in which the valve is mounted.

Figure 17:
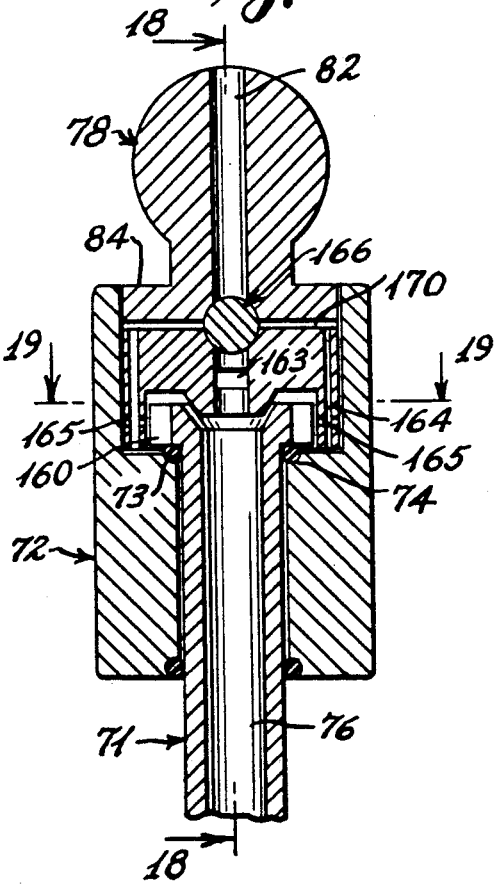
FIG. 17 is an enlarged cross-sectional view of a further embodiment of the present invention which incorporates a flow diverter assembly for controlling fluid flow to a supplemental supply shaft impeller.
Figure 18:
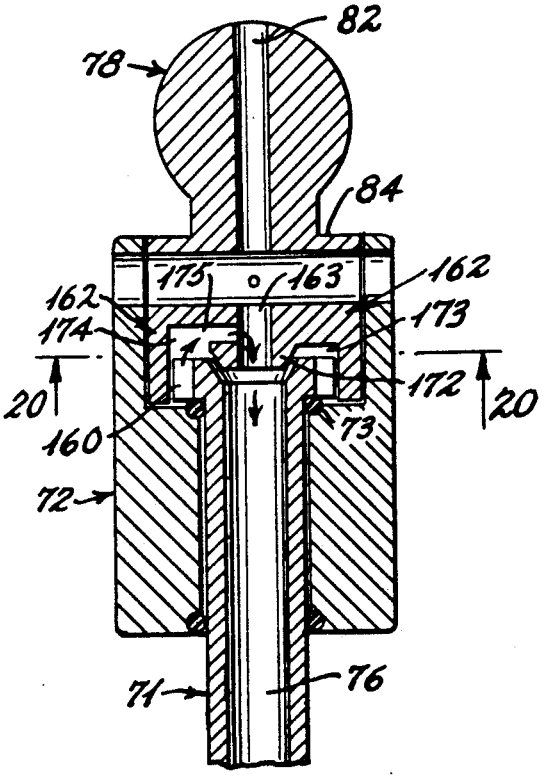
FIG. 18 is a view taken along lines 18—18 of FIG. 17.
Figure 19:
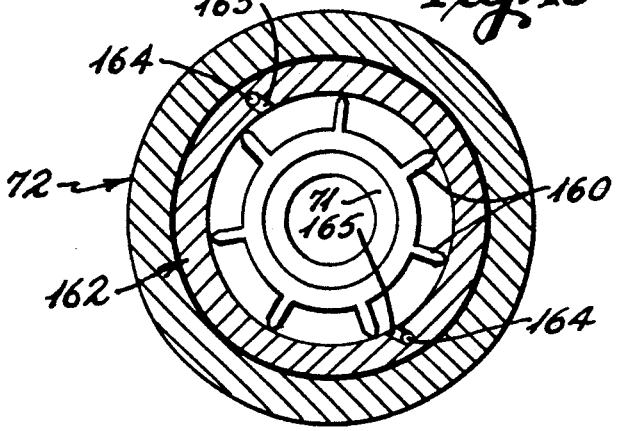
FIG. 19 is a view taken along lines 19—19 of FIG. 17.
Figure 20:
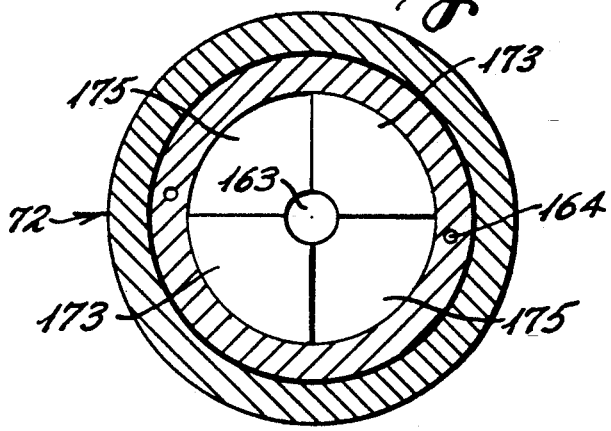
FIG. 20 is a view taken along lines 20—20 of FIG. 18.
Figure 21:
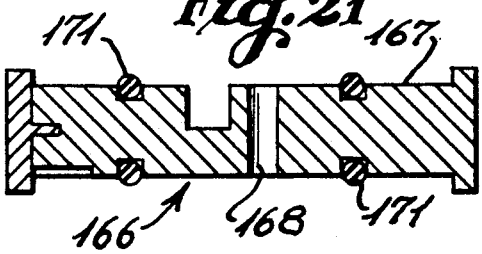
FIG. 21 is a cross-sectional view of a valve incorporated with the diverter assembly of FIG. 17.

With particular reference to FIGS. 18 and 20, the diverter assembly 162 has a profiled lower portion including a nozzle 172 which is situated within a conical opening formed within the upper portion of the supply shaft. The central channel 163 through the diverter extends through the nozzle 172. When fluid flow is diverted through the auxiliary channels 164, the fluid must be conveyed to the central channel 163 in the area of the nozzle 172 after the fluid has acted on the impeller blades 160. In order to accomplish this without interrupting or working against the rotary movement of the impeller caused by fluid flow, the fluid is introduced into two or more diametrically offset cavities 173 from the openings 165, as is shown in FIG. 17, against the blades 160 of the impeller. In this position, the fluid is not free to flow over the impellers and inwardly into the central channel 76 of the supply shaft and therefore will not adversely effect the rotational movement of the supply shaft relative to the collar 72. The fluid, however, is directed into adjacent enlarged cavities 174 which are spaced intermediate the confined cavities 173. As shown in FIG. 18, the fluid in the enlarged cavities flows through auxiliary ports 175 which communicate with the passageway 163 through the nozzle 172. A the fluid is being directed through the nozzle and does not impact against the inner surface of the impeller blades, there is little interference with the rotational movement of the impeller. Therefore, after the fluid has been introduced through the openings 165 and directed against the blades 160, the fluid is conveyed upwardly through the ports 175 and into the nozzle 172.

Although only two openings 165 and auxiliary channels 164 are shown in the drawings, it should be noted that additional openings and channels may be provided. However, each opening 165 should communicate with a confined cavity 173 so that fluid flow against the turbine blades is initially confined. In addition, there must be an enlarged cavity 174 between each of the confined cavities so as to permit fluid flow upwardly and inwardly into the passageway 163 through the nozzle 172.

It is anticipated that this variation of the invention may be incorporated utilizing a sleeve and housing which are operable in a push pull manner as set forth above with regard to FIGS. 9–16 wherein the impeller would act as an auxiliary impeller in association with the impellers disclosed in those embodiments. However, in some instances the impeller disclosed in FIGS. 17 and 18 may be utilized as the only impeller associated with the showerhead assembly. In those instances, the showerheads would still be operable in a push pull mode however the rotation of the outer housing, sleeve and supply shaft would be directly related to fluid impacting the impeller blades 160.

It should further be noted that when utilizing the auxiliary impeller in association with the central supply shaft 71, that the housing will be rotated in either of the modes described in the previous embodiments.

Figure 22:
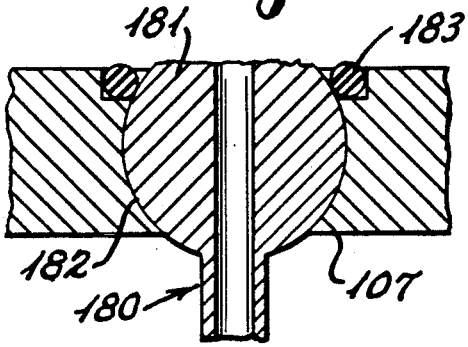
FIG. 22 is an enlarged cross-sectional view of a modified nozzle of the present invention.

Due to the additional thrust which is developed by the secondary impeller associated with the supply shaft 71, in some embodiments the angled discharge nozzles discussed in the previous embodiments may be alleviated and adjustable nozzles 180 for creating a massaging action may be utilized such as shown in FIG. 22. Such adjustable nozzles may include a ball joint 181 which is seated within a recess 182 in the face plate (such as 107) so as to be universally moveable with respect thereto. The ball joints are sealed by an O-ring 183. In such embodiments, the outer nozzles associated with the first massaging mode of operation may be selectively aimed without preventing the rotation of the showerhead housing.

Figure 15:
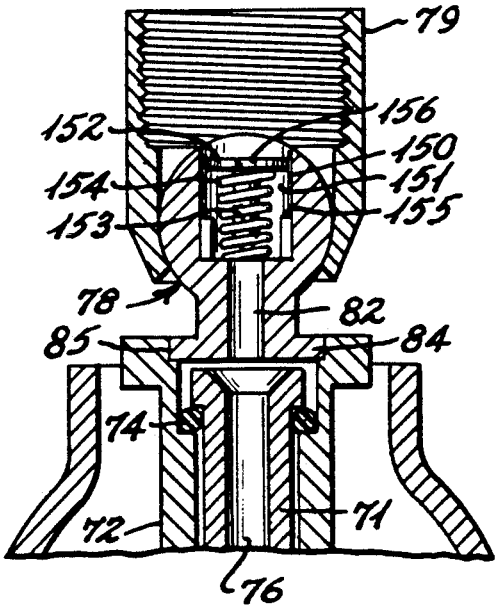
FIG. 15 is an enlarged cross-section view of a flow control valve which may be utilized with the embodiments of the present invention.
Figure 16:
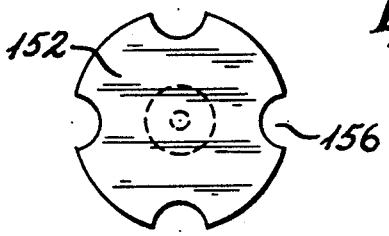
FIG. 16 is a top plan view of the valve of FIG. 15.

In addition to the foregoing, the swivel concept and the flow control concept discussed with respect to FIGS. 14–16 may be utilized in combination with the alternate or secondary impeller structure. In making such a modification, the swivel structure would be mounted within the passageway 163 of the diverter as opposed to being suspended from the adapter 78. Further, the pressure regulator assembly could be used by modification to the adapter shown in FIG. 17 and 18 so as to regulate flow through the assembly as was previously discussed.

Figure 23:
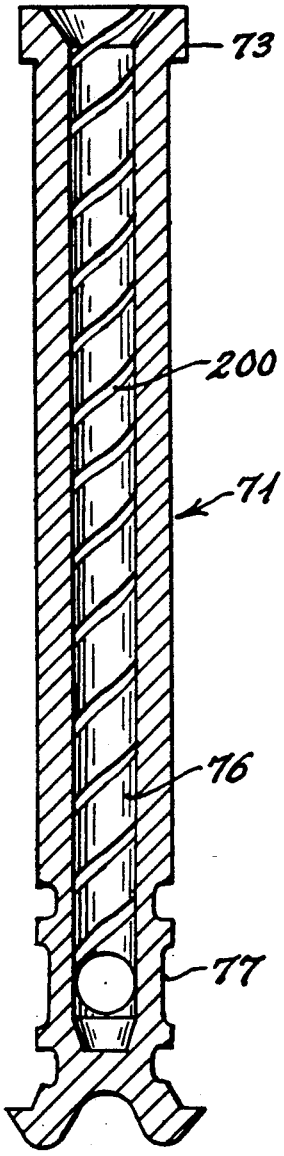
FIG. 23 is a cross-sectional view of a further embodiment showing a spiral groove formed in the fluid supply shaft.

With specific reference to FIG. 23 of the drawings another embodiment of the present invention is disclosed in greater detail. To further assist in the rotation of the outer housing of the showerhead in any of the foregoing embodiments in which the supply shaft 71 rotates with the outer housing, additional thrust may be established through the central passageway 76 of the supply shaft by either forming a spiral groove or a spiral rib 200 along the length of the inner walls defining the passageway 76. Although only a single continuous spiral groove is shown in FIG. 23 it should be noted that one or more such grooves or ribs may be formed along the side walls defining the passageway 76 through the supply shaft 71. In this manner, as water enters from the upper end of the supply shaft the water will be conveyed in a spiraling flow through the shaft which flow will assist in the rotation of the shaft and of the outer housing of the showerhead assembly.

The showerhead assemblies of the present invention are generally constructed of plastic materials with the exterior housing being of an ABS plastic coated with chrome plate. The supply shafts and sleeves are preferably formed of a generally rigid plastic material having a low coefficient of friction. The shower chambers may be formed of polypropylene or other plastic material. It should be noted that in some instances other types of material may also be utilized.

In operation, the adjustable showerhead assemblies of the present invention are capable of functioning in two different modes and in some instances may be adjusted to temporarily interrupt water flow. In the first mode of operation wherein water is discharged in a whirling massaging pattern, the sleeve is urged outwardly or downwardly with respect to the water supply shaft. In this position, fluid flow through the shaft is directed outwardly through or against the impellers in the outer chambers causing an initial rotation of the outer housings. The fluid is subsequently discharged through the thrust nozzles. During this operation the water will be rotated creating a massaging action.

When a more conventional spray pattern is desired, the outer housings and sleeves are urged upwardly relative to the water supply shafts. In this position, water will flow into the second or inner chambers and thereafter be discharged through the patterned openings in the face plates.

We claim:

1. An adjustable showerhead assembly comprising, a central fluid supply shaft having upper and lower ends, an open elongated passageway extending axially of said shaft from said upper end and terminating in spaced relationship from said lower end thereof, a lateral passageway extending through said shaft and communicating with said elongated passageway, a sleeve means having upper and lower portions and a central cavity extending between said upper and lower portions, spaced upper and lower openings in said sleeve means which communicate with said cavity, said shaft being received within said cavity, said sleeve means being axially shiftable relative to said shaft from a first position wherein said lateral passageway communicates with said upper opening to a second position wherein said lateral passageway communicates with said lower opening, an outer housing having upper and lower portions, an impeller means mounted within said housing, said impeller means being generally aligned with said upper opening in said sleeve means, an inner housing disposed within said outer housing, an outer chamber defined between said inner housing and said outer housing which encloses said impeller means and an inner chamber defined between said sleeve means and said inner housing which communicates with said lower opening in said sleeve means, face plate means for substantially closing said outer and inner chambers adjacent said lower portion of said outer housing, a plurality of first nozzle openings in said face plate means communicating with said outer chamber, a plurality of second openings in said face plate means communicating with said inner chamber, said inner and outer housings being shiftable with said sleeve means between said first and said second positions, whereby when said sleeve means is in said first position, fluid introduced through said elongated passageway in said shaft is directed through said upper opening in said sleeve means and toward said impeller mean to thereby discharge fluid through said first nozzle openings to thereby rotate said outer housing, and when said sleeve means is in said second position, fluid introduced through said elongated passageway will flow through said lower opening into said inner chamber so as to be discharged through said second openings.

2. The adjustable showerhead assembly of claim 1 including guide means for retaining said sleeve means in substantially non-rotatable orientation with respect to said supply shaft.

3. The adjustable showerhead assembly of claim 2 including upper and lower seal means mounted to said supply shaft on opposite sides of said lateral passageway.

4. The adjustable showerhead assembly of claim 3 in which said guide means includes at least one groove disposed along said supply shaft intermediate said upper and lower ends thereof, and pin means carried by said sleeve means extending into said groove.

5. The adjustable showerhead assembly of claim 4 in which said groove includes upper and lower portions, a first laterally extending recess communicating with said upper portion of said groove, said pin means being seated within said first recess when said sleeve means is in said second position, and said pin means being seated within the lower portion of said groove when said sleeve means is in said first position.

6. The adjustable showerhead assembly of claim 5 including a second laterally extending recess communicating with an intermediate portion of said groove, said pin means being seated within said second recess when said sleeve means is intermediate said first and second positions.

7. The adjustable showerhead assembly of claim 5 in which said impeller means includes a plurality of blades which are fixedly mounted with respect to said outer housing, whereby said outer housing rotates about said sleeve means when said sleeve means is in said first position.

8. The adjustable showerhead assembly of claim 7 in which, sa..id first nozzle openings include inner and outer portions which are reduced in cross section from said inner portions toward said outer portions thereof, said first nozzle openings being angled so that said outer portions thereof trail said inner portions thereof in the direction of rotation of said outer housing whereby fluid passing through said first nozzle openings creates a thrust to assist in the rotation of said outer housing about said sleeve means.

9. The adjustable showerhead assembly of claim 3 in which said lateral passageway communicates with an annular recess formed in said supply shaft.

10. The adjustable showerhead assembly of claim 1 in which said impeller means includes a plurality of channel means extending outwardly from said central cavity of said sleeve means and including outlets opening into said outer chamber.

11. The adjustable showerhead assembly of claim 10 in which said lateral passageway communicates with an annular recess formed in said supply shaft.

12. The adjustable showerhead assembly of claim 10 in which said sleeve means includes a hub, said channel means being integrally formed with said hub, said hub having an annular flange which is secured to said outer housing, whereby said sleeve means rotates with said outer housing when in said first position.

13. The adjustable showerhead assembly of claim 12 including a support collar means having upper and lower ends and an elongated opening therethrough, said fluid supply shaft being rotatably supported within said elongated opening whereby said fluid supply shaft, said sleeve means and said outer housing rotate together relative to said collar means when said sleeve means is in said first position.

14. The adjustable showerhead assembly of claim 13 in which said inner housing includes at least one annular wall member integrally formed with said face plate means, said at least one annular wall member extending inwardly of said outer housing and engaging said hub of said sleeve means.

15. The adjustable showerhead assembly of claim 13 including friction means for retaining said sleeve means with respect to said fluid supply shaft 16. The adjustable showerhead assembly of claim 15 in which said first nozzle openings include inner and outer portions and are tapered between said inner and outer portions, and said first nozzle openings being angled so that said outer portions thereof trail said inner portions thereof in the direction of rotation of said outer housing.

17. The adjustable showerhead assembly of claim 13 in which said collar means includes a recess in said upper end thereof, said fluid supply shaft including an upper end disposed within said recess, secondary impeller means carried by said upper end of said supply shaft and surrounding said elongated passageway therethrough, a flow diverter means mounted within said recess and about said secondary impeller means for selectively directing fluid toward said secondary impeller means to rotate said supply shaft.

18. The adjustable showerhead assembly of claim 17 in which said flow diverter means includes a central channel which is aligned with said elongated passageway of said supply shaft, a valve means disposed within said central channel, a plurality of auxiliary channels communicating through said valve means with said central channel, said auxiliary channels having discharge openings for directing fluid against said impeller means, and means for channeling fluid from said impeller means to said central channel.

19. The adjustable showerhead assembly of claim 1 in which said impeller means includes a plurality of arcuate conduit means having first and second ends, a plurality of said upper openings in said sleeve means, said first ends of said conduit means communicating with said upper openings, said lower ends of said conduit means communicating with said first nozzle openings, and said first nozzle openings being inclined so as to discharge fluid therefrom in a direction opposite the direction of rotation of said outer housing when said sleeve means is in said first position.

20. The adjustable showerhead assembly of claim 19 including a support collar means having upper and lower ends and an elongated opening therethrough, said fluid supply shaft being rotatably supported within said elongated opening whereby said fluid supply shaft, said sleeve means and said outer housing rotate together relative to said collar means when said sleeve means is in said first position.

21. The adjustable showerhead assembly of claim 20 including friction means for retaining said sleeve means relative to said supply shaft.

22. The adjustable showerhead assembly of claim 21 in which said inner housing includes an annular hub integrally formed with said sleeve means and extending outwardly intermediate said upper and lower openings, and an outwardly extending annular flange which extends from said hub to engagement with said face plate means.

23. The adjustable showerhead assembly of claim 20 in which said collar means includes a recess in said upper end thereof, said fluid supply shaft including an upper end disposed within said recess, secondary impeller means carried by said upper end of said supply shaft and surrounding said elongated passageway therethrough, a flow diverter means mounted within said recess and about said secondary impeller means for selectively directing fluid toward said secondary impeller means to rotate said supply shaft.

24. The adjustable showerhead assembly of claim 23 in which said flow diverter means includes a central channel which is aligned with said elongated passageway of said supply shaft, a valve means disposed within said central channel, a plurality of auxiliary channels communicating through said valve means with said central channel, said auxiliary channels having discharge openings for directing fluid against said secondary impeller means, and means for channeling fluid from said secondary impeller means to said central channel.

25. The adjustable showerhead assembly of claim 1 including a support collar means having upper and lower ends and an elongated opening therethrough, said fluid supply shaft being rotatably supported within said elongated opening whereby said fluid supply shaft, said sleeve means and said outer housing rotate together relative to said collar means when said sleeve means is in said first position.

26. The adjustable showerhead assembly of claim 25 including a seal means carried by said upper end of said collar means, said fluid supply shaft including an annular flange adjacent said upper end thereof, said annular flange being rotatably seated on said seal means.

27. The adjustable showerhead assembly of claim 26 including an adapter means having base and body portions and a central passageway therethrough, said base being mounted to said upper end of said collar means, swivel means carried by said adapter means, and means for connecting said swivel means to said fluid supply shaft so as to be oriented generally axially therewith whereby said fluid supply shaft is at least partially rotatably supported by said swivel means.

28. The adjustable showerhead assembly of claim 25 in which said collar means includes a recess in said upper end thereof, said fluid supply shaft including an upper end disposed within said recess, secondary impeller means carried by said upper end of said supply shaft and surrounding said elongated passageway therethrough, a flow diverter means mounted within said recess and about said secondary impeller means for selectively directing fluid toward said secondary impeller means to rotate said supply shaft.

29. The adjustable showerhead assembly of claim 28 in which said flow diverter means includes a central channel which is aligned with said elongated passageway of said supply shaft, a valve means disposed within said central channel, a plurality of auxiliary channels communicating through said valve means with said central channel, said auxiliary channels having discharge openings for directing fluid against said impeller means, and means for channeling fluid from said impeller means to said central channel.

30. The adjustable showerhead assembly of claim 28 in which said first nozzle openings ar adjustable with respect to said outer housing.

31. The adjustable showerhead assembly of claim 28 in which said elongated passageway through said supply shaft is defined by sidewalls, and at least one spiral fluid directing means extending along said sidewalls.

32. The adjustable showerhead assembly of claim 25 in which said elongated passageway through said supply shaft is defined by sidewalls, and at least one spiral fluid directing means extending along said sidewalls.

33. The adjustable showerhead assembly of claim 1 in which said elongated passageway through said supply shaft is defined by sidewalls, and at least one spiral fluid directing means extending along said sidewalls.

34. The adjustable showerhead assembly of claim 1 including valve means for regulating the pressure of fluid flow through said elongated passageway of said fluid supply shaft.

35. The adjustable showerhead assembly of claim 34 including adapter means for connecting said fluid supply shaft to a source of fluid supply, said adapter means having a fluid passageway therethrough, a valve seat formed within said fluid passageway, a valve means, and resilient means for urging said valve means from said valve seat and being yieldable to close said valve means toward said valve seat when the pressure of fluid from the source of said supply exceeds a predetermined value.

* * * * *